US006370832B1

(12) United States Patent
McGarry et al.

(10) Patent No.: US 6,370,832 B1
(45) Date of Patent: Apr. 16, 2002

(54) INTERLOCKING PANEL WITH CHANNEL NAILING HEM

(75) Inventors: Benjamin L. McGarry, Akron; Jack Thomas Mowery, Medina, both of OH (US)

(73) Assignee: Associated Materials, Inc., Cuyahoga Falls, OH (US)

( * ) Notice: Subject to any disclaimer, the term of this patent is extended or adjusted under 35 U.S.C. 154(b) by 0 days.

(21) Appl. No.: 09/321,739

(22) Filed: May 28, 1999

(51) Int. Cl.[7] ..... E04D 1/34

(52) U.S. Cl. ..... 52/520; 52/539; 52/529; 52/545; 52/549; 52/553; 52/557

(58) Field of Search ..... 52/529, 539, 545, 52/549, 553, 557, 520

(56) References Cited

U.S. PATENT DOCUMENTS

| | | | | | |
|---|---|---|---|---|---|
| 1,714,682 | A | * | 5/1929 | Loucks | 52/529 |
| 2,739,676 | A | | 3/1956 | Tomita | |
| 3,325,952 | A | | 6/1967 | Trachtenberg | |
| 3,504,467 | A | | 4/1970 | Hatch et al. | |
| 3,590,543 | A | | 7/1971 | Helrich | |
| 3,606,720 | A | * | 9/1971 | Cookson | 52/545 X |
| 3,633,327 | A | * | 1/1972 | Klingensmith | 52/798.1 X |
| 3,738,076 | A | | 6/1973 | Kessler | |
| 4,334,396 | A | | 6/1982 | Hagopian | |
| 4,548,017 | A | * | 10/1985 | Blando | 52/798.1 |
| 4,669,238 | A | | 6/1987 | Kellis et al. | |
| 4,930,287 | A | | 6/1990 | Volk et al. | |
| 5,140,793 | A | | 8/1992 | Knudson | |
| 5,305,570 | A | | 4/1994 | Rodriguez et al. | |
| 5,490,359 | A | * | 2/1996 | Helper | 52/520 X |
| 5,535,567 | A | | 7/1996 | Cahoon | |
| 5,564,246 | A | | 10/1996 | Champagne | |
| 5,651,227 | A | | 7/1997 | Anderson | |
| 5,675,955 | A | | 10/1997 | Champagne | |
| 5,768,844 | A | | 6/1998 | Grace, Sr. et al. | |
| 5,878,543 | A | * | 3/1999 | Mowery | 52/529 X |
| 6,026,624 | A | | 2/2000 | Patel et al. | |

* cited by examiner

*Primary Examiner*—Carl D. Friedman
*Assistant Examiner*—Phi Dieu Tran A
(74) *Attorney, Agent, or Firm*—Banner & Witcoff Ltd.

(57) ABSTRACT

A vinyl siding panel which includes a top lock, a medial main body portion, a bottom lock, and a nailing hem adjacent the top lock comprises a channel with nail apertures in the channel base for receiving siding nails. The channel has an open end which has a dimension smaller than the nail head diameter so that the nail head bears against shoulders or bearing surfaces formed adjacent the channel. The channel can be of rectangular or tapered cross-section in order to space the nail head away from the nail apertures and thereby eliminate stress concentrations at the apertures. The lock structures are generally complementary in shape so that they interlock with other siding panels of like construction. The panel can be reinforced along its length for added rigidity. One area of reinforcement is the channel nailing hem which can be reinforced by extruding additional material to form the channel or by providing an elongated trough-like insert nested within the channel. The channel nailing hem provides improved wind resistance and enhances strength and rigidity of the panel.

14 Claims, 14 Drawing Sheets

INTERLOCKING PANEL WITH CHANNEL NAILING HEM

FIELD OF THE INVENTION

The present invention pertains to interlocking panels with enhanced ruggedness and improved wind resistance, and in particular, to panels having channel nailing hems primarily intended for use as siding on houses and other structures.

BACKGROUND OF THE INVENTION

Siding composed of vinyl or other plastic material is a common medium for use as an external covering of a structure. Such siding is fabricated as elongate panels having connectors formed along the lengths of the upper and lower edges. In use, the siding panels are arranged in horizontal interlocking tiers. In general, siding panels include a top lock that is configured to interlock with a bottom lock of another panel. A nailing hem comprising a series of slots for receiving nails to attach the panel to an underlying structure is generally provided near the top lock of each panel.

A premium siding panel will frequently be formed by a pair of materials fused together. The outer layer or capstock is composed of a weather, wear and impact resistant material which also provides a good appearance. The underlayer or substrate is composed of a stiffer material to increase the strength of the panel. A focus of vinyl siding development has been improved resistance to winds. When a building is buffeted by winds, the stress concentration occurs at the nail slots in the nailing hem, and various configurations have been proposed to improve the attachment of the panel to the underlaying wall.

Conventional nailing hems can be classified into three general categories: single thickness, multiple thickness and rollover. Examples of single thickness nailing hems are illustrated in FIGS. 1A–2B. In FIGS. 1A–1B and 2A–2B, conventional siding panel 10 includes a top lock 12, a nailing hem 14, a bottom lock 16, and a medial body 18. Body 18 ordinarily has a pair of faces 20, 22 separated by a center butt 24. Top lock 12 is bent to form a dogleg protrusion 26 which extends downwardly over the upper face 20 of the siding panel to form a groove 28. Bottom lock 16 has a channel-like shape. The distal wall 30 of the bottom lock is inclined back toward the lower face 22 of the body. The distal wall 30 of one panel is snugly fit within groove 28 of another panel to interlock the adjacent siding panels. Nailing hem 14 extends upward from top lock 12 and is provided with elongated slots 32 into which siding nails N or staples or screws are driven to attach the panel to an underlaying wall.

In general siding nails are not driven into the wall fully so that the nail head undersurface does not bear against the nailing hem. This clearance accommodates movement of the panels which occur due to fluctuations in temperature and other environmental conditions. In general, when nails N are driven through the nail slots, and the installed panels are exposed to winds, the panel will tend to move in the direction of arrow A in FIG. 1B. This forces the panel against the nail head and the nail head exerts a load on a flat surface of the panel. The nail slot is thus the locus of a stress concentration, and eventually the slot can open further and ultimately can tear due to wind load.

The panel of FIGS. 1A–1B has a conventional lock geometry, and the panel of FIGS. 2A–2B has a more robust lock geometry in which the top lock occupies much more of the space in the channel-like bottom lock.

Examples of nailing hems configured of a double thickness of siding material are shown in FIGS. 3A–3B and 4A–4B. Double thickness nailing hems are formed by providing additional panel material in a folded-over configuration. Siding panel 10 of FIGS. 3A–3B includes a variation on the top and bottom locks as well. Top lock 12 has an integrally formed double thickness nailing hem 14 above the lock structure, and a triangular cross-section lock with a free leg 34 opposite the upper face 20. Bottom lock 16 has on its distal wall 30 an integrally formed hook 36 at its tip. When adjacent panels are interconnected, hook 36 of the bottom lock slides past free leg 34 of the adjacent lock and fits snugly against upper face 20 as shown in FIG. 3B. Nailing hem 14 is provided with elongated nail slots to receive siding nails N or staples. Another embodiment of a double thickness nailing hem 14 is shown in FIGS. 4A–4B which shows a reinforced dog-leg type top lock 12. The lock structure in this type of panel is configured so that the top lock occupies much of the space in the channel shape of the bottom lock so that the top lock abuts against lower face 22 of the adjacent panel. The top lock is also reinforced with an additional strip of material to enhance the rigidity of the panel, particularly in the lock area. Again, as with single thickness nailing hems, siding nails N are driven only to the extent that the undersurface of the nail head does not contact the nailing hem. While the double thickness nailing hem provides improved strength, the stress concentrations around the nail slot are still present and pose the same problems as the single thickness. That is, when subject to high winds, the nail head will tend to further open the slots and can ultimately lead to failure.

Examples of nailing hems with a rollover shape are shown in FIGS. 5A–5B and 6A–6B. Panel 10 illustrated in FIGS. 5A–5B has a conventional lock structure with nailing hem 14 extending above top lock 12. Nailing hem 14 has an open roll 40 formed at its top end. Siding nails N or staples or screws are driven to secure panel 10 to the extent that the undersurface of the nail head bears against roll 40. The panel illustrated in FIGS. 6A–6B also has a conventional lock structure with nailing hem 14 extending above the top lock. Nailing hem 14 has a closed roll 42 formed at its top end. Siding nails N are driven to secure panel 10 to the extent that the undersurface of the nail head bears against roll 42. In both of these types of nailing hems, elongate slots are provided for siding nails N. In these rollover nailing hems, much of the force that the nails exert on the nailing hems are borne by the roll portions to alleviate the stress concentrations on the nail slots. However, rollover nailing hems are an imperfect solution because upon wind loading, the panels tend to move and the nail head tends to exert a load on the flat surfaces around the nail slots making tearing and failure more likely.

SUMMARY OF THE INVENTION

The present invention pertains to interlocking panels having a channel nailing hem above the top lock. A channel nailing hem provides improved nail holding capacity which translates to increased wind resistance, and more rigidity to the panel. The panel has a top lock, a medial body portion, and a bottom lock. The locks are complementary in shape so that they interlock with other panels of like construction.

The rigidity of the panel can be further enhanced by forming the panel with areas of increased substrate thickness along selected portions of the panel. Another way is to affix an additional strip of material to at least one of the lock portions or other panel portion for rigidifying the panel. The strip can be of the same material as the panel or a higher strength material, and can be co-extruded with the panel. Greater rigidity enables easier installation of the panels in an interlocked manner. The panels of the present invention can even be installed by one person. Moreover, the present invention provides a stronger overall construction which permits the use of the panels as siding in coastal areas and other environments which have wind load requirements. In those situations, vinyl siding must exhibit increased nail holding capability.

In one aspect of the invention, the channel in the nailing hem has an open rectangular cross-section above the top lock with elongated slots in the base of the channel. When siding nails, staples or screws are driven into the nail slots, the undersurface of the nail or screw head bears against the surfaces formed by the sides of the channel to eliminate stress concentrations around the slots and improve wind resistance. When staples are used, one leg of the staple is driven into the nail slot and the other leg is driven above the top edge of the panel with the crossbar of the staple overlaying one wall of the channel.

In another aspect of the invention, the channel has an open trapezoidal cross-section with the wider side forming the base with elongated slots provided, and the narrower side forming the opening. When siding nails are driven into the nail slots, the undersurface of the nail head bears against the surfaces formed by the sides of the channel. This eliminates stress concentrations around the slots and the narrower opening ensures that the nail heads will remain above the channel.

In yet another aspect of the invention, the channel of the nailing hem itself is reinforced either by forming the substrate with increased thickness, co-extruding a strip of material or by providing a separate trough that fits within the channel. This reinforcement to the nailing hem channel provides more protection against failure around the nail slots and also rigidifies the panel.

In still another aspect of the invention, the panel is reinforced by increasing the thickness of the substrate or by a strip of additional material co-extruded along its length. This reinforcement can be provided anywhere along the panel, most preferably in one or both of the lock elements.

These and other features and advantages of the invention may be more completely understood from the following detailed description of the preferred embodiment of the invention with reference to the accompanying drawings.

DETAILED DESCRIPTION OF THE PREFERRED EMBODIMENTS

The present invention pertains to interlocking panels composed of vinyl or other plastic materials. The panels are primarily intended for use as siding installed on buildings and other structures. The panels have a novel construction which enhances the strength of the siding structure, most particularly by providing improved wind resistance. In general the channel nailing provides increased rigidity to the panel, and rigidity can be further enhanced along any portion of a panel by increasing the thickness of the panel or co-extruding a strip of material with the panel.

Figure 7A:
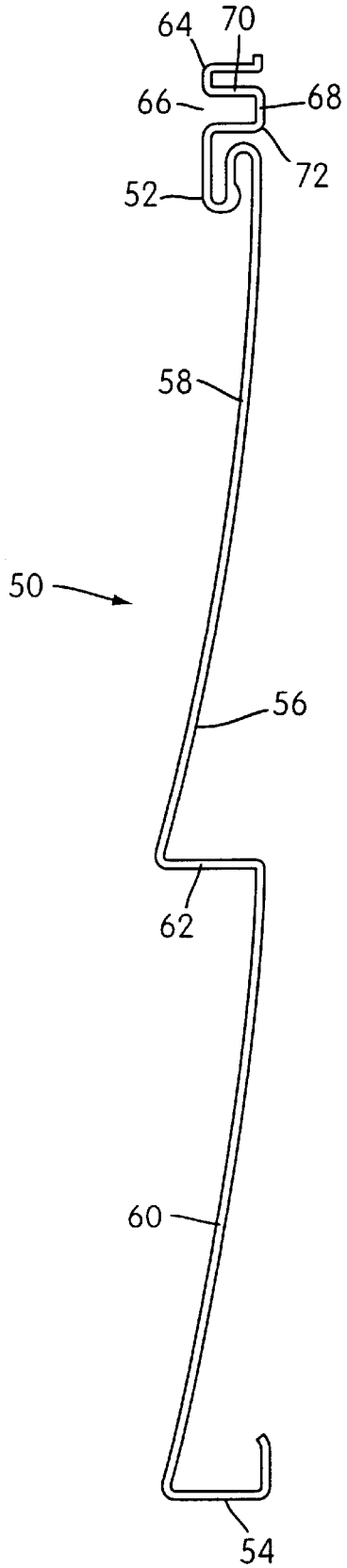
FIG. 7A is a side view of a siding panel with a channel nailing hem in accordance with a first preferred embodiment of the invention.
Figure 7B:
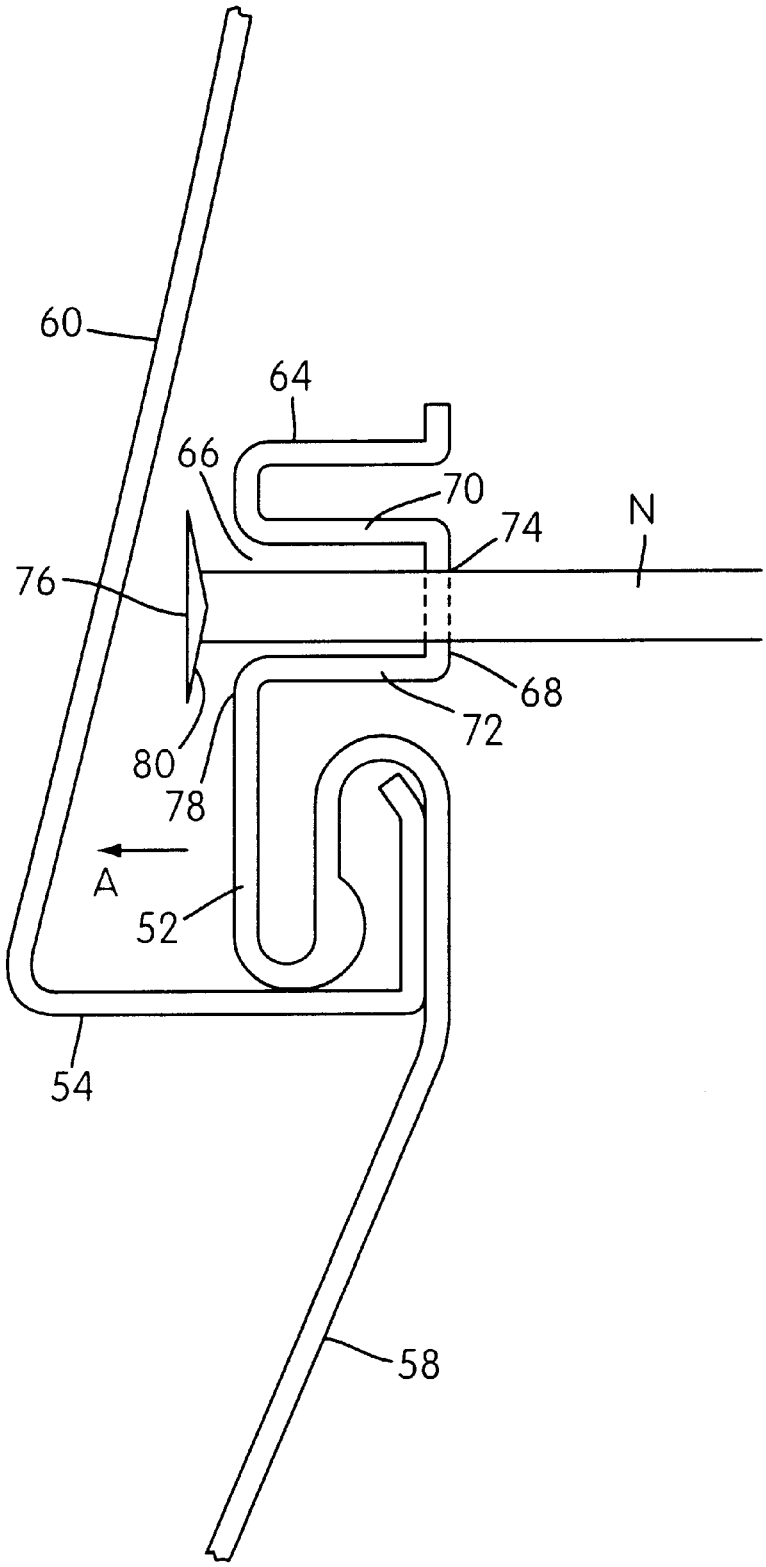
FIG. 7B is a detailed side view of adjacent siding panels of the construction of the panel shown in FIG. 7A shown interconnected.

In the preferred embodiments, like reference numerals are used to refer to like parts. The following description refers to specific attachment hardware such as nails, screws and staples. It will be understood that the term "nail" is used in a broad sense and includes screws and other hardware as well. In one preferred embodiment, a siding panel 50, FIGS. 7A–7C, in accordance with the present invention includes a top lock 52, a bottom lock 54 and a medial body portion 56. Body portion 56 can have a wide variety of configurations, but preferably includes a pair of vertical face sections 58, 60 separated by a center butt or ledge 62. The top and bottom locks can also have a wide range of shapes. Locks 52 and 54 have complimentary shapes so that siding panels can be interlocked together, FIG. 7B, that is, top lock 52 interlocks with bottom lock 54 of an adjacent siding panel. Panel 50 includes a nailing hem 64 provided above the top lock. Nailing hem 64 includes a channel 66 defined by a channel base 68 and channel sides 70 and 72. Elongated nail slots 74 are provided in channel base 68 for receiving siding nails N which secure panel 50 to an underlaying wall or wall studs. Nail N is driven into the channel 66 and through slot 74 to the extent that nail head 76 is positioned to the outside of channel 66. Channel sides 70 and 72 are generally parallel and is open to one end opposite the base. Adjacent to sides 70 and 72 are perpendicularly arranged bearing surfaces 78 of the nailing hem.

The arrangement of the channel and nail when the panel is installed is such that undersurfaces 80 of nail head 76 will bear against bearing surfaces 78 of the nailing hem. In this manner, channel 66 and the bearing surfaces 78 take the load imposed by nail head 76 when the installed siding panel is exposed to winds. Wind loading on installed siding panels will tend to move the panel in the direction of arrow A in FIG. 7B, so that nail head 76 imposes a load on bearing surfaces 78 of the nailing hem. Because the bearing surfaces 78 are designed to take the load, and because the nail slot is formed in the base and away from the bearing surfaces, this nailing hem eliminates the stress concentrations at the slot so prevalent in prior art siding panels.

Figure 7C:
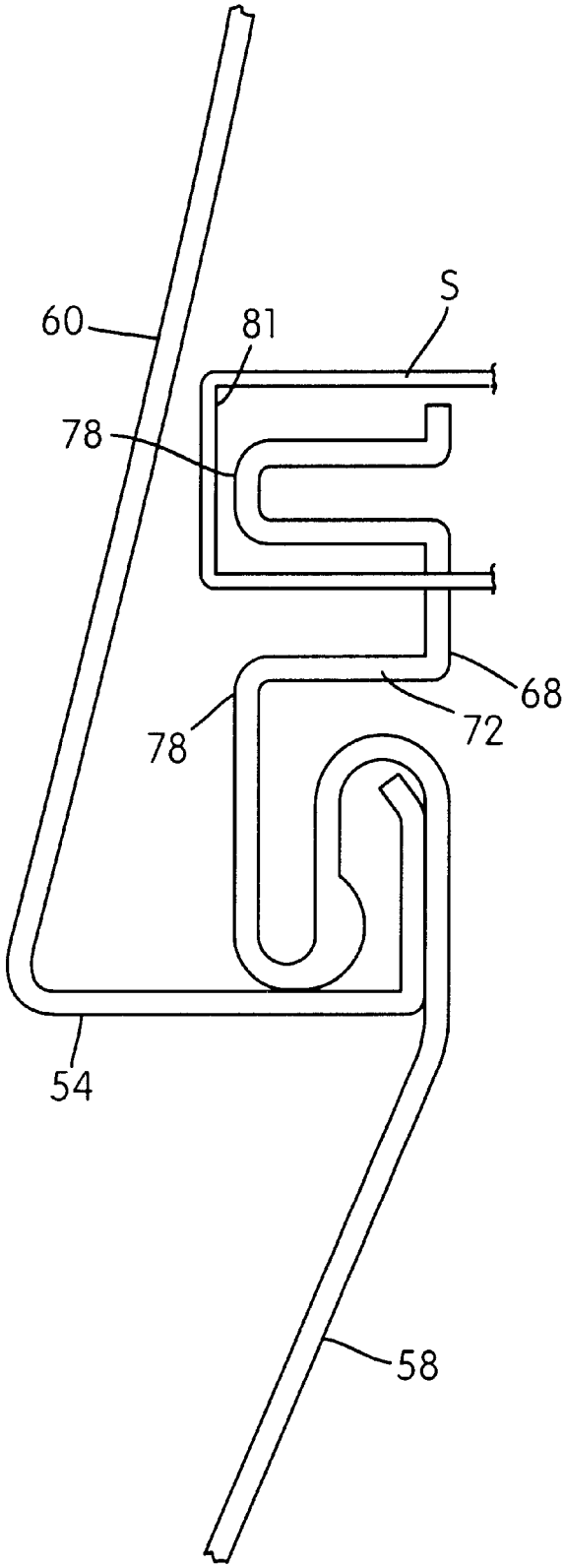
FIG. 7C is a detailed view similar to FIG. 7B but showing the panel attached with a staple.

When the same panel is attached to an underlaying wall or studs with staples S, FIG. 7C, the same principles for eliminating stress concentrations apply. One leg of the staple is driven through the nail slot and the other leg is driven above the top edge of the panel. Crossbar 81 of the staple overlays bearing surface 78 on the top end of the nailing hem. In this manner, the undersurface of crossbar 81 bears against bearing surface 78 so that when the panel is subject to winds, the crossbar of the staple is loaded by the panel. The spacing of the crossbar away from the nail slot in this manner eliminates the stress concentrations around the slot which occur when conventional siding panels are stapled to studs.

Figure 8A:
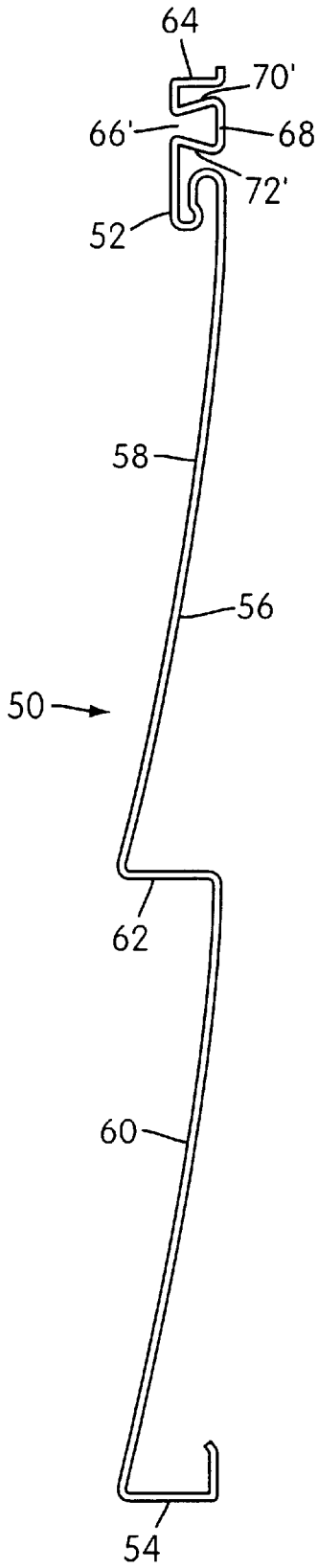
FIG. 8A is a side view of a siding panel with a channel nailing hem in accordance with a second preferred embodiment of the invention.
Figure 8B:
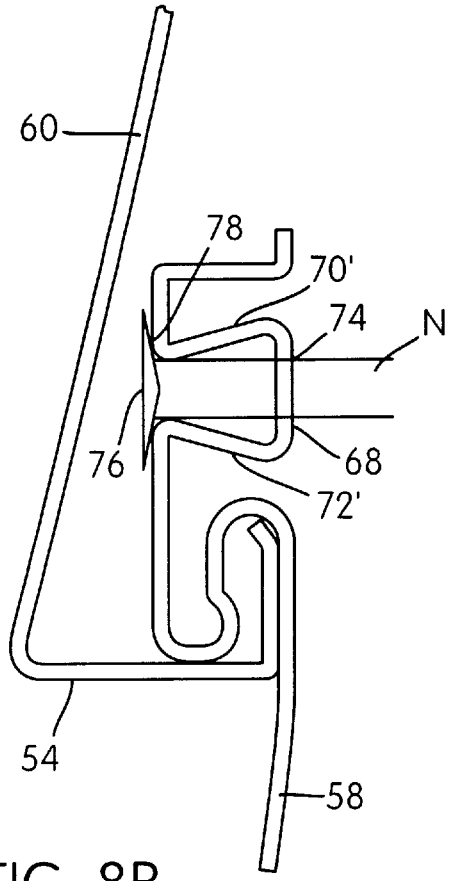
FIG. 8B is a detailed side view of adjacent siding panels of the construction of the panel shown in FIG. 8A shown interconnected.

Another embodiment of a channeled nailing hem is illustrated in FIGS. 8A and 8B in which channel 66' has a trapezoidal cross-section comprising a base 68 forming the wide base of the trapezoid, sides 70' and 72' which are angled to form the converging sides of the trapezoid. The narrower end of the trapezoid shape is the channel opening. In this configuration bearing surfaces 78 of the nailing hem are closer together. As seen in FIG. 8B, when a siding nail N is driven into the channel and through slot 74 in the base 68, the undersurface of the nail head 76 bears against bearing surfaces 78 such that angled sides 70' and 72' of the channel provide structural support for the load imposed by the nail head. Of course the nail slot is spaced away from the point of load so as to eliminate any stress concentrations around the slot.

Figure 8C:
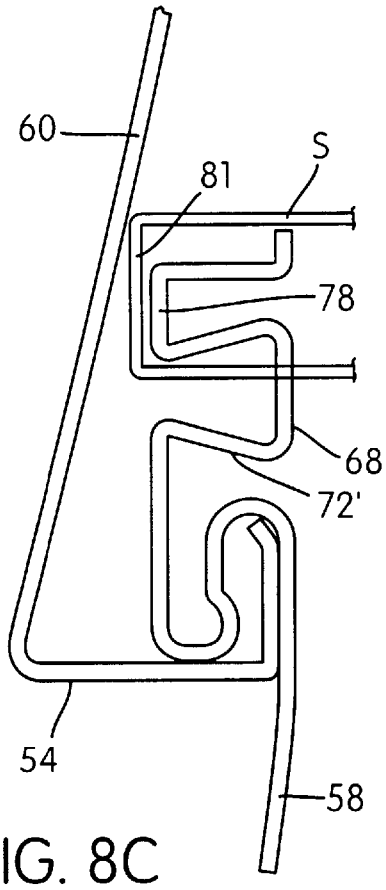
FIG. 8C is a detailed view similar to FIG. 8B but showing the panel attached with a staple.

Again, when this type of panel is attached with staples S, FIG. 8C, crossbar 81 of the staple is loaded by the panel as in the embodiment of FIG. 7C.

A channeled nailing hem also provides for improved rigidity and ruggedness to the siding panel as a whole due to the channel convolutions, which is especially advantageous during installation. While the embodiments of the channel nailing hem discussed herein include the rectangular and trapezoidal cross-section, other shapes that would provide bearing surfaces for the nail head, such as a circular arc, are contemplated to be within the scope of the present invention.

Figure 9:
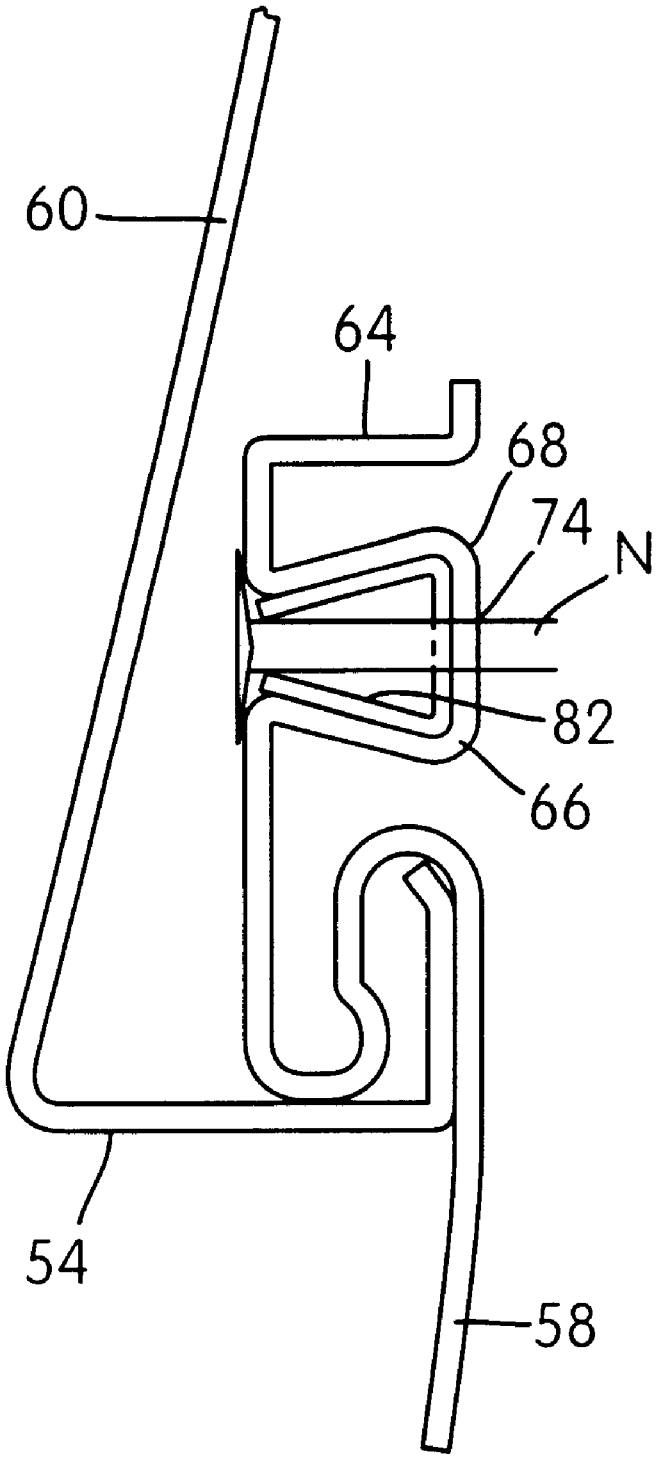
FIG. 9 is a detailed side view of adjacent siding panels with a reinforced channel nailing hem in accordance with a third preferred embodiment of the invention.

Another embodiment of the present invention provides a reinforced channel in the nailing hem. FIG. 9 illustrates one manner of providing the reinforcement in the way of an insert or trough piece 82 which fits into channel 66. Insert 82 is provided with elongated slots which are arranged in corresponding relation to nail slots 74 at the base 68 of the channel. The insert may be a metal or thermoplastic piece, and may be secured in the channel by an interference fit or possibly with an adhesive.

The channel could also be reinforced during the extruding process by making the channel area of a thicker cross-section or coextruding a strip of additional material to strengthen the channel walls. The reinforcement to the channel will further enhance the strength of the panel attachment to the underlaying wall or wall stud.

Figure 1A:
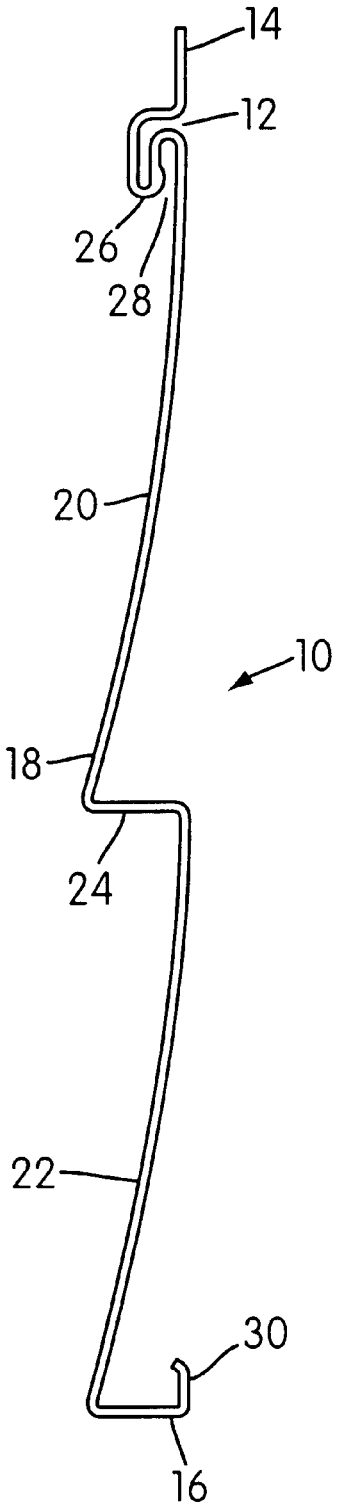
FIG. 1A PRIOR ART
FIG. 1A is a side view of a siding panel of a conventional lock structure with a conventional single thickness nailing hem.
Figure 1B:
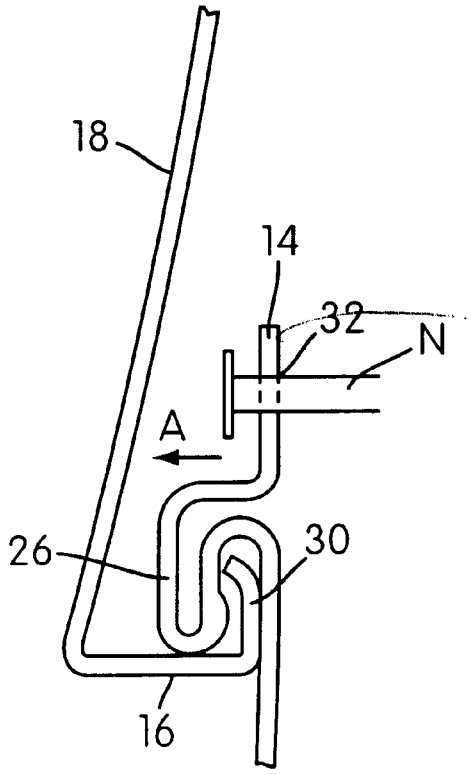
FIG. 1B PRIOR ART
FIG. 1B is a detailed side view of adjacent siding panels of the construction of the panel shown in FIG. 1A shown interconnected.
Figure 2A:
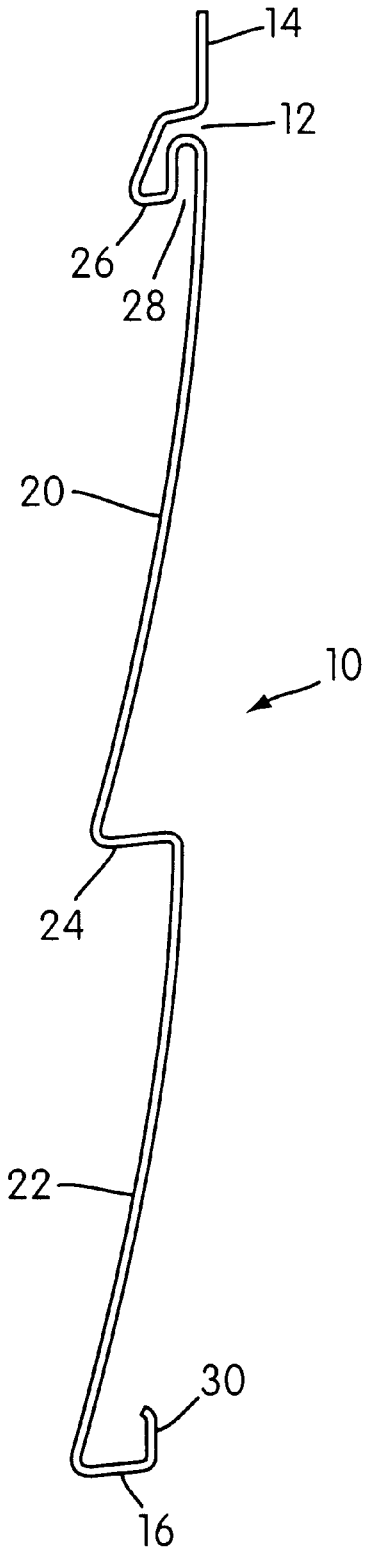
FIG. 2A PRIOR ART
FIG. 2A is a side view of a siding panel of an enhanced lock structure with a conventional single thickness nailing hem.
Figure 2B:
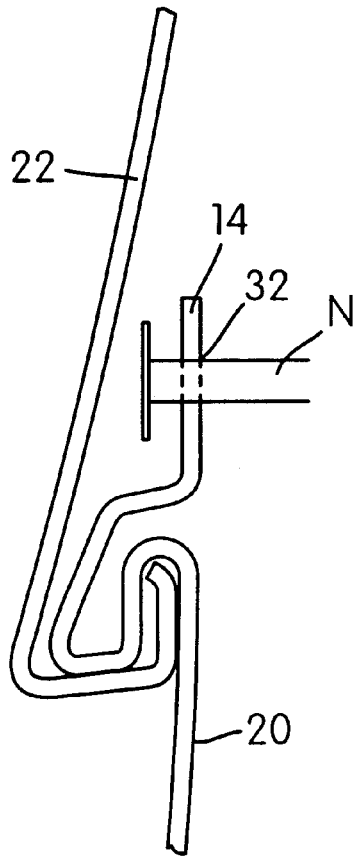
FIG. 2B PRIOR ART
FIG. 2B is a detailed side view of adjacent siding panels of the construction of the panel shown in FIG. 2A shown interconnected.
Figure 3A:
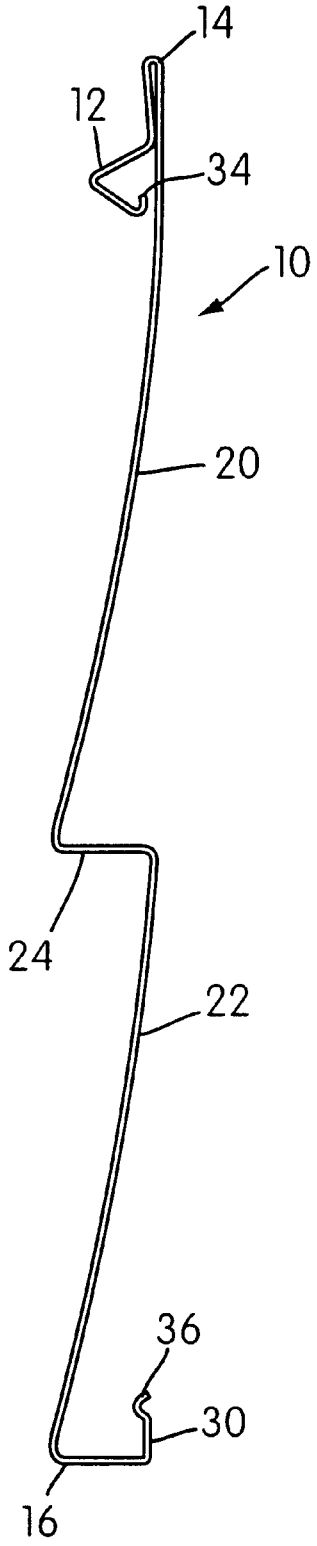
FIG. 3A PRIOR ART
FIG. 3A is a side view of a siding panel of a conventional lock structure with a conventional double thickness nailing hem.
Figure 3B:
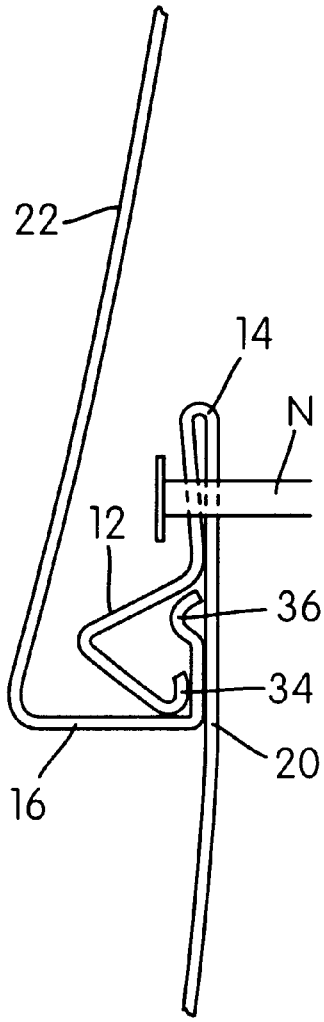
FIG. 3B PRIOR ART
FIG. 3B is a detailed side view of adjacent siding panels of the construction of the panel shown in FIG. 3A shown interconnected.
Figure 4A:
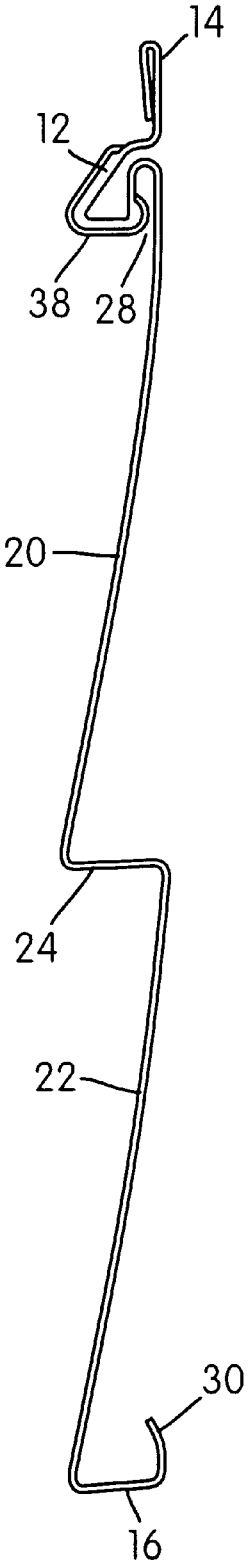
FIG. 4A PRIOR ART
FIG. 4A is a side view of a siding panel of a reinforced lock structure with a conventional double thickness nailing hem.
Figure 4B:
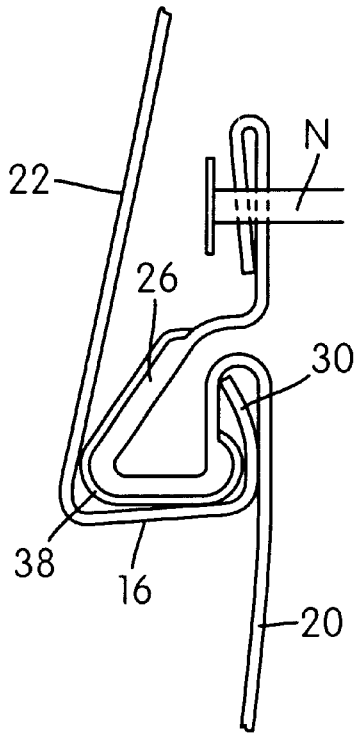
FIG. 4B PRIOR ART
FIG. 4B is a detailed side view of adjacent siding panels of the construction of the panel shown in FIG. 4 shown interconnected.
Figure 5A:
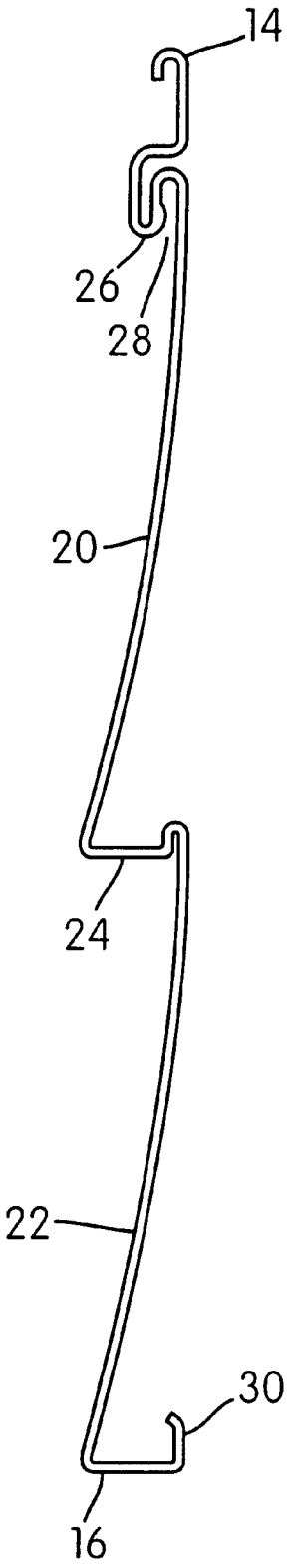
FIG. 5A PRIOR ART
FIG. 5A is a side view of a siding panel of a conventional lock structure with a conventional open roll nailing hem.
Figure 5B:
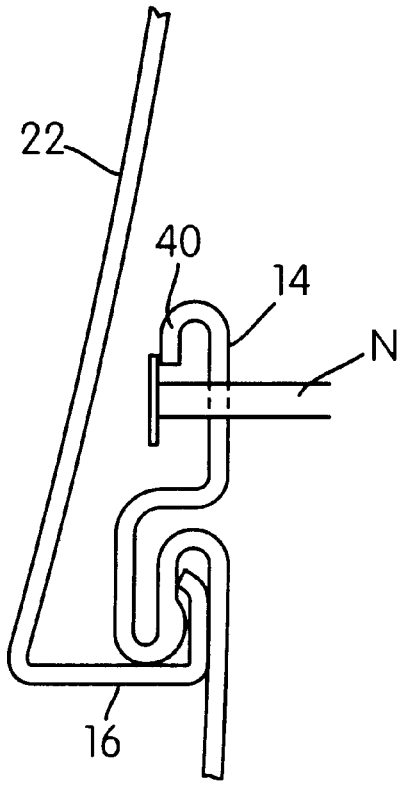
FIG. 5B PRIOR ART
FIG. 5B is a detailed side view of adjacent siding panels of the construction of the panel shown in FIG. 5A shown interconnected.
Figure 6A:
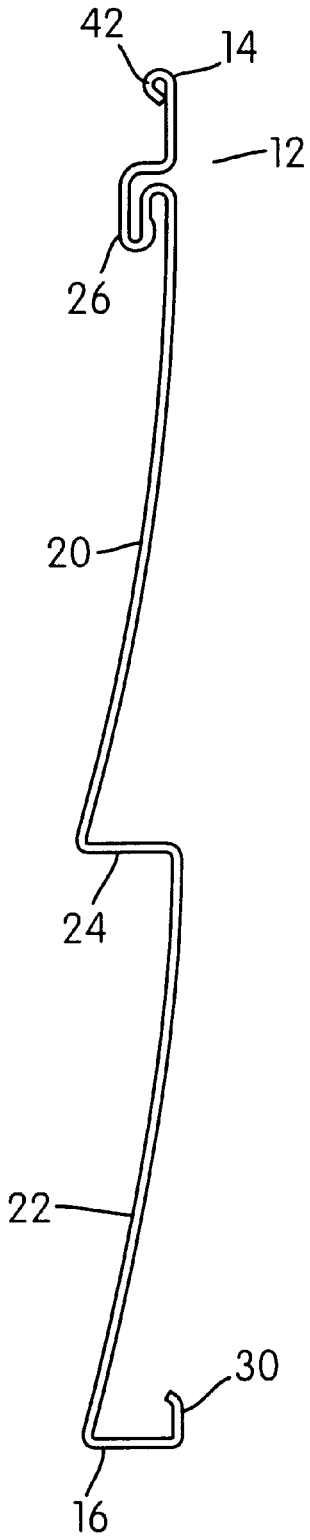
FIG. 6A PRIOR ART
FIG. 6A is a side view of a siding panel of a conventional lock structure with a conventional closed roll nailing hem.
Figure 6B:
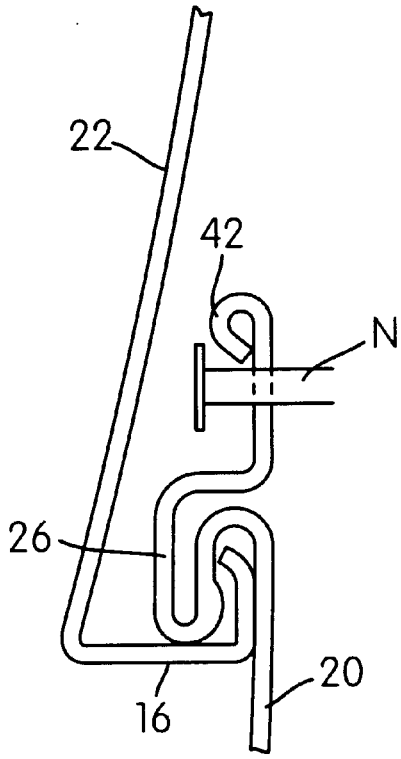
FIG. 6B PRIOR ART
FIG. 6B is a detailed side view of adjacent siding panels of the construction of the panel shown in FIG. 6A shown interconnected.

All of the channel nailing hems described heretofore can be integrated to a panel having the improved lock structure geometry of shown in FIGS. 4A–4B. Specifically, even without the reinforcing strip, the geometry of the locking structure in which the top lock 12 has a generally horizontally projecting wall and an elongate inclined wall extending up from the projecting wall, and the bottom lock has an L-shaped projection complimentary in shape to the top lock. When the top lock is interconnected with a bottom lock, at least a portion of the projecting wall of the top lock abuts against the horizontal arm of the bottom lock so that a portion of the inclined wall abuts against the body face 22. In this manner, the top lock occupies most of the space defined by the bottom lock, and the installed panels are sturdier. This lock structure may be used with a reinforcement such as shown in FIG. 4A, or without such reinforcement.

Figure 10A:
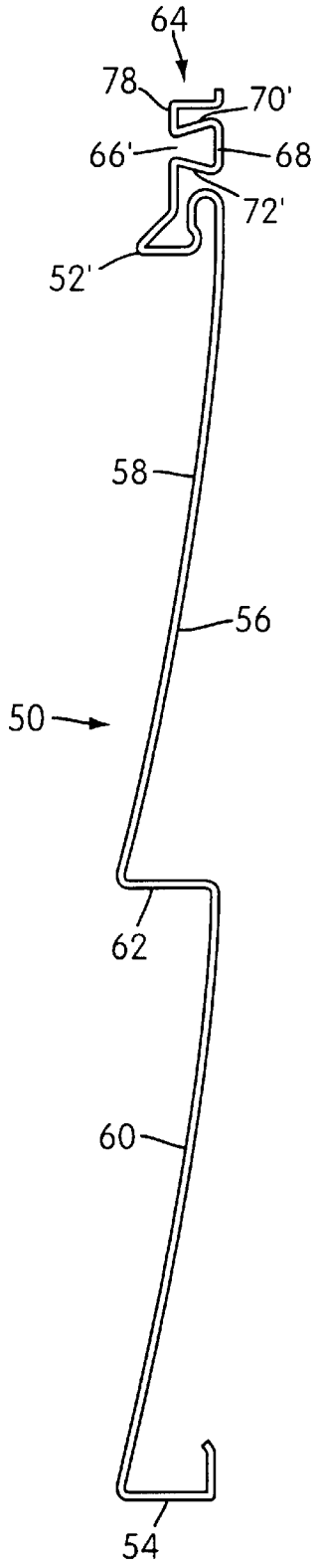
FIG. 10A is a side view of a siding panel with a channel nailing hem in accordance with another preferred embodiment of the invention.
Figure 10B:
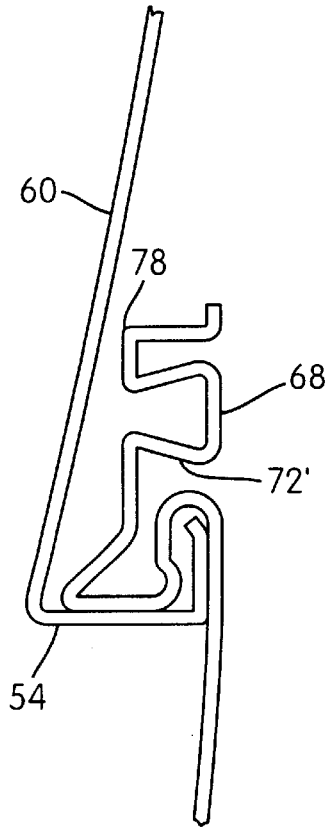
FIG. 10B is a detailed side view of adjacent siding panels of the construction of the panel shown in FIG. 10A shown interconnected.

In yet another embodiment of the invention, FIGS. 10A–10B, siding panel 50 is provided with a larger dog-leg type top lock 52' which is configured so that the top lock occupies much of the space in the channel shape of bottom lock 54. Top lock 52' has a projecting wall and an elongate inclined wall extending upward from the projecting wall which, when interlocked with a bottom lock of another panel can be configured to abut against the body portion of the adjacent panel. Nailing hem 64 includes a trapezoidal channel 66' defined by a channel base 68 and channel sides 70' and 72'. Elongated nail slots are provided in channel base 68 for receiving siding nails N or staples S which secure panel 50 to an underlaying wall or wall studs. As with previous embodiments, when attachment hardware is used to secure panel 50 to an underlaying wall, it can be seen that the undersurface of a nail head or a staple cross bar would be supported and bear against bearing surfaces 78 formed by channel sides 70' and 72'.

Figure 11:
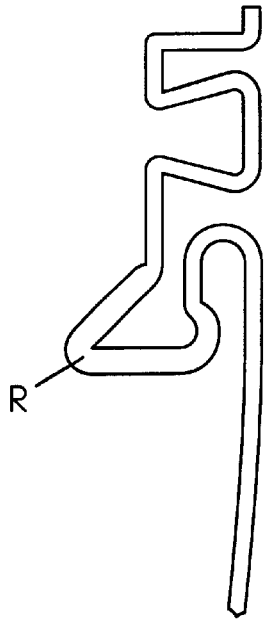
FIG. 11 is a schematic illustration of the panel of FIG. 10A shown with a reinforcement option.
Figure 12:
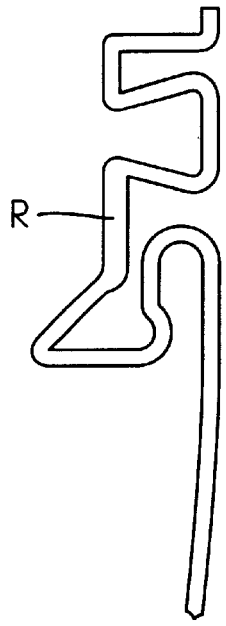
FIG. 12 is a schematic illustration of the panel of FIG. 10A shown with a reinforcement option.

Two possibilities for reinforcing the panel are illustrated schematically in FIGS. 11 and 12 using panels identical to the one shown in FIGS. 10A–10B. The area reinforced is indicated by the letter R. In FIG. 11 the top lock portion is reinforced, and in FIG. 12 a portion of the panel that provides a bearing surface is reinforced. The reinforcement can be accomplished by forming the desired areas of thicker substrate material or by co-extruding another material in that area. While these two possibilities for reinforcement are shown, it will be understood that such thickening or co-extrusion can be done anywhere along the panel.

Figure 13:
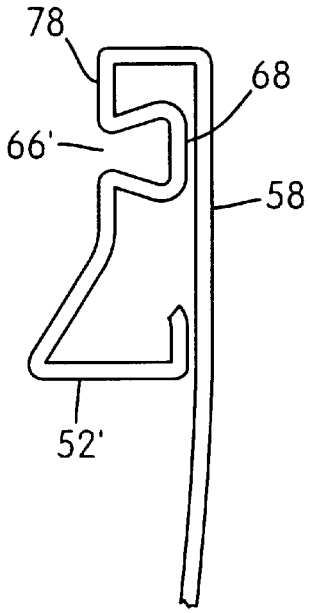
FIG. 13 is a schematic view of a panel in accordance with another preferred embodiment.

An alternative lock structure is shown schematically in FIG. 13 in which the top lock and channel structure formed by the edge of the panel being folded over. Top lock 52' has a dog-leg configuration with a free edge of the panel material being disposed so as to hook onto a bottom lock upward leg. A nail channel 66' is formed above the top lock with the upper face 58 in opposition to the channel base 68. In this manner, corresponding nail slots are punched in the channel base 68 and upper face 58, through both thicknesses of material. Contrary to the prior art double-thickness nail hems, the configuration shown in FIG. 13 would have increased nail holding capability since the nail head or staple crossbar would be spaced away from the nail slots to eliminate stress concentrations.

While the embodiments described herein are siding panels with a top lock and a bottom lock which extend horizontally along a wall, it is contemplated to be within the scope of the invention to apply the improved nailing channel to any attachment area of building panels that may be differently oriented when installed. Broadly, the lock structure comprises first and second edge structures and a nailing area located somewhere between the edge structures.

As is common in the industry, the siding panels described herein can be composed of a variety of plastic materials. Preferably, the panels are composed primarily of PVC resins. The capstock or exterior layer is formulated to have a good appearance and to be weather, wear and impact resistant. The substrate or interior layer is formulated primarily for stiffness and strength. Nevertheless, other constructions including only one material or more than two materials could be used to form the layers or plies of the siding panel.

In the embodiments of the invention in which an additional material is co-extruded onto the panel, co-extrusion refers to two or more extrudates. Co-extrusion includes the use of an identical material as that of the siding panel or a different material. A high strength material that could be used is preferably a compounded, reinforced PVC material. One such material is known as GEON Fiberloc 925 GR30 manufactured by GEON Corporation. Another alternative material is known as Tuf-Stif manufactured by Georgia Gulf Corporation. Other high strength materials including other plastics or materials (e.g., graphite or boron) may also be used.

The siding panels described herein are preferably made of thermoplastic material. The structural advantages of the channel nailing hem are also adaptable to panels made of metal sheets as well, and the invention is not limited to vinyl siding.

The above discussion concerns the preferred embodiments of the present invention. Various other embodiments as well as many changes and alterations may be made without departing from the spirit and broader aspects of the invention as defined in the claims.

What is claimed is:

1. A siding panel comprising:

a top lock;

a body portion;

a bottom lock, said top lock and said bottom lock being configured to enable interlocking with other panels of like construction; and a nailing hem comprising a channel and having an open end, opposing channel side portions forming planar side walls and bearing surfaces for supporting attachment hardware, and an opposing channel base with nail apertures adapted to receive attachment hardware thereinto for attaching said panel to an underlaying structure, wherein said side walls are angled at ninety degrees or less from said channel base, said bearing surfaces are co-planar with an outer surface of said top lock and said open end has a width dimension adapted to be smaller than a siding nail head diameter dimension.

2. An exterior building panel adapted to be attached to an underlaying wall or studs by siding nails, screws, or staples, said panel comprising:

top and bottom lock structures configured to interlock with lock structures of an identical panel positioned adjacent thereto;

a nailing strip adjacent one of said top and bottom lock structures, said nailing strip extending along a length of said panel and comprising a channel having a channel base, an opposing open end with a width dimension adapted to be less than a siding nail head diameter, opposing channel side wall portions forming side walls and bearing surfaces for supporting undersurfaces of siding nail heads or staples, said side walls angled at ninety degrees or less from said channel base, and said bearing surfaces co-planar with an outer surface of adjacent said top lock structure.

3. The building panel of claim 2, wherein said channel is of rectangular cross-section with said channel base being parallel to said open, and said opposing side portions being parallel to one another.

4. The building panel of claim 2, wherein said channel is of tapering cross-section with said side walls being planar angled side walls.

5. The building panel of claim 2, wherein said channel is of trapezoidal cross-section with said channel base being wider than said open end.

6. The building panel of claim 2, wherein said channel is reinforced.

7. The building panel of claim 6, wherein said channel is reinforced by an area of increased thickness.

8. The building panel of claim 6, wherein said channel is reinforced by a strip of additional material co-extruded therewith.

9. The building panel of claim 2, further comprising an insert adapted to be received in said channel.

10. The building panel of claim 9, wherein said insert extends along the entire length of said channel.

11. The building panel of claim 9, wherein said insert is formed of metal.

12. The building panel of claim 9, wherein said insert is shaped to be nestingly received in said channel.

13. The building panel of claim 2, wherein at least a portion of said panel has an increased thickness for enhanced rigidity.

14. The building panel of claim 2, wherein at least a portion of said panel has a strip of additional material co-extruded therewith for enhanced rigidity.

* * * * *